US006702132B1

(12) United States Patent
Moore et al.

(10) Patent No.: US 6,702,132 B1
(45) **Date of Patent: *Mar. 9, 2004**

(54) CRANE SELF-ASSEMBLY SYSTEM

(75) Inventors: Donald E. Moore, Lexington, KY (US); Steven F. Wilms, Lexington, KY (US)

(73) Assignees: Link-Belt Construction Equipment Company, L.P., LLLP, Lexington, KY (US); Sumitomo Construction Machinery, Lexington, KY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/272,115

(22) Filed: Mar. 19, 1999

(51) Int. Cl.[7] ..... B66C 23/34
(52) U.S. Cl. ..... 212/270; 212/175; 212/177
(58) Field of Search ..... 212/175, 177, 212/180, 250, 176, 178, 179, 181, 270

(56) References Cited

U.S. PATENT DOCUMENTS

| | | | | | |
|---|---|---|---|---|---|
| 2,595,897 | A | * | 5/1952 | Shoemaker | 212/180 |
| 2,664,212 | A | * | 12/1953 | Bell | 212/180 |
| 2,784,850 | A | * | 3/1957 | Batson et al. | 212/176 |
| 3,071,255 | A | | 1/1963 | Bill | |
| 3,146,893 | A | | 9/1964 | Eckels et al. | |
| 3,929,204 | A | * | 12/1975 | Newell | 212/145 |
| 4,000,784 | A | | 1/1977 | Morrow, Sr. et al. | |
| 4,050,586 | A | | 9/1977 | Morrow, Sr. et al. | |
| 4,064,615 | A | * | 12/1977 | Andersson | 212/177 |
| 4,081,081 | A | | 3/1978 | Morrow, Sr. et al. | |
| 4,196,814 | A | | 4/1980 | Reich | |
| 4,467,928 | A | | 8/1984 | White | |
| 4,579,234 | A | | 4/1986 | Delago et al. | |
| 4,660,731 | A | * | 4/1987 | Becker | 212/175 |
| 4,662,527 | A | | 5/1987 | Cuhel | |
| 4,967,917 | A | * | 11/1990 | Koizumi et al. | 212/168 |
| 5,005,714 | A | * | 4/1991 | Kroll et al. | 212/178 |
| 5,140,929 | A | * | 8/1992 | Gaspard | 212/270 |
| 5,240,129 | A | | 8/1993 | Schrick et al. | |
| 5,484,069 | A | | 1/1996 | Lanning | |
| 5,960,970 | A | * | 10/1999 | Walker | 212/294 |

FOREIGN PATENT DOCUMENTS

| | | | | |
|---|---|---|---|---|
| CH | 465807 | * | 1/1969 | 212/177 |
| GB | 981129 | * | 1/1965 | 212/177 |

* cited by examiner

*Primary Examiner*—Thomas J. Brahan
(74) *Attorney, Agent, or Firm*—King & Schickli, PLLC

(57) ABSTRACT

A method of assembling a heavy duty mobile crane having a load handling boom that has a boom base section and other component parts. The method includes positioning the component parts adjacent said crane, such as on a truck, raising the parts from the truck bed in sequence with a self-contained lifter associated with said base section, lowering and placing each part in a position adjacent ground level for connection to said crane, and then connecting the parts to the crane so as to provide a complete working crane. The method applies particularly to assembling the boom sections and connecting them to the crane. Extension sections of the boom are handled by placing them at ground level and preassembling the sections to form an upper boom, and then connecting the upper boom to the base section. The method steps are reversed to disassemble the crane. The method also includes transporting the crane to a work site with the boom base section connected to the mobile crane. The apparatus to carry out the method includes a lifter, preferably a pair of hydraulic cylinders, mounted in the base section of the boom. A line, such as a wire rope, is attached to each cylinder and extends over a sheave adjacent the distal end of the base section. A sling may be attached to the hook on the end of the lines for handling the component parts of the crane. For certain parts, such as counterweights, a hook or other connector is attached directly to the part. The lines are snugged when not in use with the hook/connector coupled to an eye on the underside of the boom base section.

9 Claims, 6 Drawing Sheets

CRANE SELF-ASSEMBLY SYSTEM

BACKGROUND OF THE INVENTION

The present invention relates to the operation of a mobile crane and the related apparatus, and more particularly, to self-assembly of a traveling crane utilizing a self-contained lifter.

Mobile cranes have either crawler tracks for moving about a work site, or built in wheels that allow work site movement and direct over-the-road travel. If tracks are employed, the crane is moved by a tractor trailer from one site to the next. These two versions of cranes make up a substantial portion of the crane market. A significant sought after advantage is of course the ability to move from work site to work site in a very short time. In this manner, the construction company can make very efficient use of their capital equipment. In the past, this has been a particular focus for design of not only light-to-medium duty cranes, but also in recent years to heavy duty cranes. However in the past, especially in the operation of medium to heavy duty cranes, one factor remains a particular hindrance. There has usually been a need for having an attending light duty crane to assist in erecting the mast, assembling the boom, placing the counterweight units and other component parts in position and other make-ready functions before the crane can begin the work for which it is intended.

For the traveling mode of the heavy duty crane, the base unit of the crane is constructed as large and heavy as possible, subject only to the restrictions of the over-the-road travel. In other words, it is desirable to leave as much of the structure that can be, assembled as the base unit. This reduces the assembly and make ready time at the work site, as well as the disassembly work time once the crane's work is completed and moving to the next work site is desired. In this regard, it would be very desirable to leave the boom base section attached to the crane base unit, since this is one of the heavier component parts of the crane. Other parts of the crane, such as boom sections for the upper boom, the counterweight units, the crawler tracks and other heavy component parts, may be more conveniently removed and transported on separate tractor trailers. Once at the work site, if the crane boom base can be left in place, the main boom support pins are already secure. Thus, this proposal not only substantially reduces the time for assembly, but also substantially reduces the inspection effort to insure that the crane is work-ready.

In the past, there has been some development in making a crane to be self-assembling and self-disassembling. One of the most successful approaches is shown in Applicant's own U.S. Pat. No. 5,240,129, issued Aug. 1, 1993. The technology set forth in this patent provides for self-erecting the live mast, and then rerigging the crane using a wire rope and a hoisting drum for adding all of the other component parts, including the boom base section. This approach while the most successful to date requires some improvement in the area of limiting the special rigging in order to successfully carry it out. The installation and operation of the special rigging is time consuming in itself. After each successful assembly or disassembly of the crane the rigging must be changed to be made ready for work or transport.

Other less efficient approaches have been taken in the past. These methods share the common drawback of also needing special rigging and using the main hoist drums in order to carry the function of assembly and disassembly. An example of such a system is illustrated in U.S. Pat. No. 5,484,069, issued Jan. 16, 1996. In particular, the rigging process includes steps of repositioning the main load line from its working position over the sheave at the top of the boom and connecting it over a separate sheaves in the boom base section. This requires not only removal and rerouting of the main load line, but rerigging it through the separate sheaves on the boom base section. Such a process is not only time consuming, but also very tedious and requires several operators working together to accomplish the task and properly inspect it when completed.

Other, earlier methods have been used, but also with little success in terms of efficiently handling the assembly/disassembly operation, such as illustrated in U.S. Pat. No. 4,579,234, issued Apr. 1, 1986.

Previously, in some very light duty cranes, there have been proposals for stowing the boom over the cab of the vehicle by using hydraulic power cylinders connected adjacent the gantry, along with additional, very complicated rear mounted linkage. Such an approach is exemplified by the structure shown in the U.S. Pat. No. 3,146,893, issued Sep. 1, 1964. Clearly however, this proposal is not instructive as to some medium to heavy duty mobile cranes since leaving the boom connected for travel is not feasible due to the weight consideration.

Thus, there is identified a need for an improved method, and related apparatus for self-assembly (and disassembly) of relatively large, medium to heavy duty cranes. A particular characteristic of this approach would be to leave the boom base section connected to the base unit of the crane during travel, not only for more efficient delivery to the original customer, but more importantly for more efficient use by the contractor moving between work sites. Also, it is contemplated that this would be accomplished with a self-contained dedicated lifter in the boom base section. As a result, the assembly or erection, and disassembly of the heavy duty crane could be efficiently carried out in a much shorter time than heretofore possible, and without the need for a separate, attendant crane being on the work site. Since the main pins are left in place, the inspection time should also be reduced.

SUMMARY OF THE INVENTION

Accordingly, it is a primary object of the present invention to provide a method and a crane particularly adapted for self-assembling, and thereby overcoming the limitations and shortcomings of the prior art, as set forth above.

It is another object of the present invention to provide a self-assembling method and related apparatus for a crane in which the operations can be carried out with a self-contained lifter permanently mounted in the base section of the boom.

Another object of the present invention is to provide the method of self-assembly and disassembly utilizing hydraulic cylinder means that are mounted in a self-contained manner within the base boom section.

Still another object of the present invention is to provide a crane assembly method and related apparatus that allows self-assembly of the load handling boom, as well as all other component parts to the crane, through dedicated hydraulic cylinders housed within the confines of the boom base section.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved method of self-assembling and (disassembling) a crane, including a load handling boom, and the apparatus to carry out the method in an efficient manner on a self-contained basis, is provided. The crane is particularly adapted for transport, or for direct over-the-road operation in a fast turnaround time. The crane to which the concept of the present invention applies is in the medium to heavy duty range so that some component parts must be carried on separate tractor trailer transport vehicles in order to remain within the highway weight limits imposed by the U.S. and state governments.

An important feature is to provide for the boom base section to remain on the base unit or works section of the crane. While the present invention will thus be described in the preferred embodiment illustrated with respect to a particular medium/heavy duty crane, and one mounted on crawler tracks, it will be recognized that the same approach can be utilized in any form of crane having a load handling boom. Also, while the particular operation is illustrated on a mobile crane having a live mast, within the broadest aspects of the invention other approaches for assisting in the support of the boom could be used.

The method of the present invention includes bringing the component parts, such as the upper or extension sections, to the customer in the first instance, or to the work site during contractor use, on a separate truck. The boom and/or other parts are raised from the trailer bed in sequence by use of the self-contained lifter associated with the boom base section. The crane then moves, including a 180° rotation of the upper works if desired, to a separate location for assembly of the boom and/or for attaching other component parts. The boom sections or other parts being carried are lowered in a position adjacent the ground level. The extension sections are connected together to form an upper boom for later connection to the boom base section to form the complete boom of the working crane.

As will be realized by those of skill in the art, the method steps are reversed to disassemble the crane and make ready the crane to be moved to a new work site. During the disassembly, the upper boom is disassembled, other component parts are removed, and all are placed back on the transport trailers by use of the boom base section. Advantageously, the boom base section remains connected to the base unit of the crane at all times and is dedicated to this function in the sense that no rerigging is required to make it fully operative.

Other than the boom extension sections being removed and transported to and from the work site on special trailers, the next most important parts to be handled in this manner are the counterweight units. Typically, such a counterweight unit weighs in the range of 20,000–50,000 pounds and can be easily handled by the self-contained lifter associated with the boom base section, in accordance with the present invention. For assembly, each counterweight unit is lifted from the bed of the trailer, lowered to a position adjacent the ground at a convenient location, disconnected and then lifted from the ground by the gantry assembly and moved to its normal location up on the rear of the crane base unit.

The preferred apparatus to carry out the method of the present invention includes a pair of hydraulic cylinders to form the lifter within the boom base section. The cylinders are self-contained in the base section with a lift line connected to the distal end of the piston within each cylinder. The line, such as a wire rope, extends over a sheave adjacent the distal end of the base section. An important feature is that the cylinders and the associated lift lines remain in/with the base section, respectively.

Within the broadest aspects of the present invention, the lifter may employ in lieu of the cylinders, a pair of small winches or drums for the lift lines, but it will be recognized that for incorporation in the restricted confines of the boom base section, the use of cylinders, especially because of their narrow dimensions, is preferred.

A sling may be attached to the hook on the end of each of the lines for handling the boom extensions, and other large component parts. For the counterweight units, and for other more compact parts, a load hook or other connector is attached directly to the part. When not in use carrying out the function of assembly and disassembly, the lifter lines may be snugged along the lower edge of the boom base section after simply being coupled to an attachment eye.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
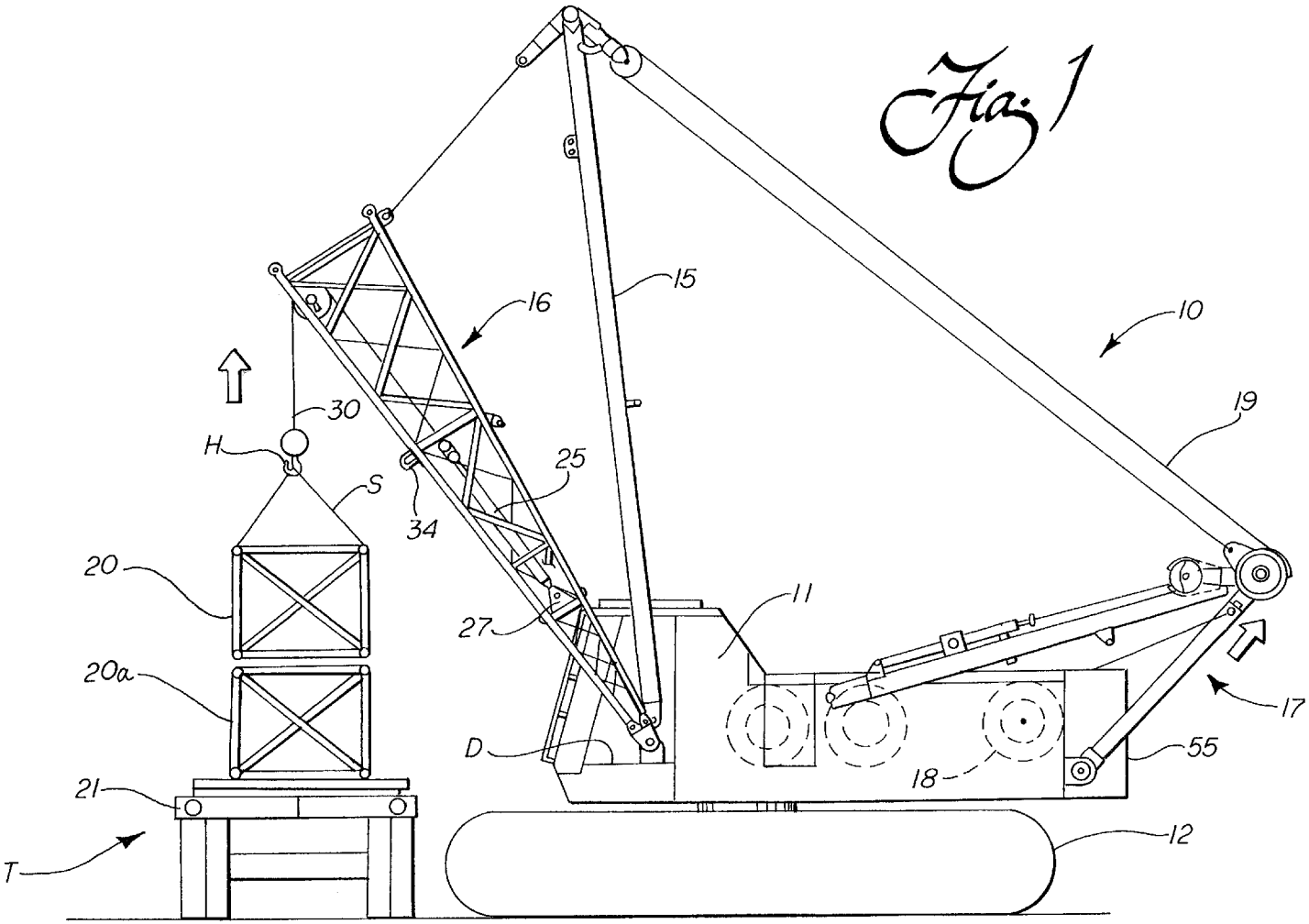
FIG. 1 is an overall side view of a mobile crane built in accordance with the present invention and illustrating an initial step of lifting an upper boom section from a transport trailer.

Reference is now made to FIG. 1 of the drawing showing a relatively medium/heavy duty, mobile crane 10, which as will be recognized is assembled except for its upper boom and the counterweight. As illustrated, the crane 10 includes a crane base unit (or upper/lower works) 11 carried on crawler tracks 12 (one shown in FIG. 1 in schematic form). While the crawler tracks are shown on this particular mobile crane, it is to be understood that the principles of the present invention would also apply to cranes with wheels that are adapted for direct over-the-road travel as well.

The crane 10 also includes a live mast 15 constructed. to have the self-erecting feature, as more fully illustrated in applicant's prior U.S. Pat. No. 5,240,129, described above. Pivotally attached to the deck D of the crane base unit 11 is a boom base section, which in the particular embodiment shown is of the lattice work type structure, and generally designated by the reference numeral 16. Other component parts of the crane include a gantry assembly, generally designated by the reference numeral 17. A rear power winch or drum 18 is shown in dashed line form, and connected to a multi pass operating line 19 for the live mast 15.

In accordance with the method of the present invention, the self-assembling operation of the crane 10 is initiated by attachment and lifting of the extension sections 20, 20*a–x* from the trailer T in sequence. The sections are later to be fixed to the distal or upper end of the boom base section 16 (illustrated in FIG. 2). The trailer T is placed adjacent the crane 10 with the boom sections 20, 20*a* loaded on the bed 21. As illustrated, the first boom section 20 is just being lifted free from stacked on the second boom section 20*a* and is ready for delivery to the assembly area.

Figure 3:
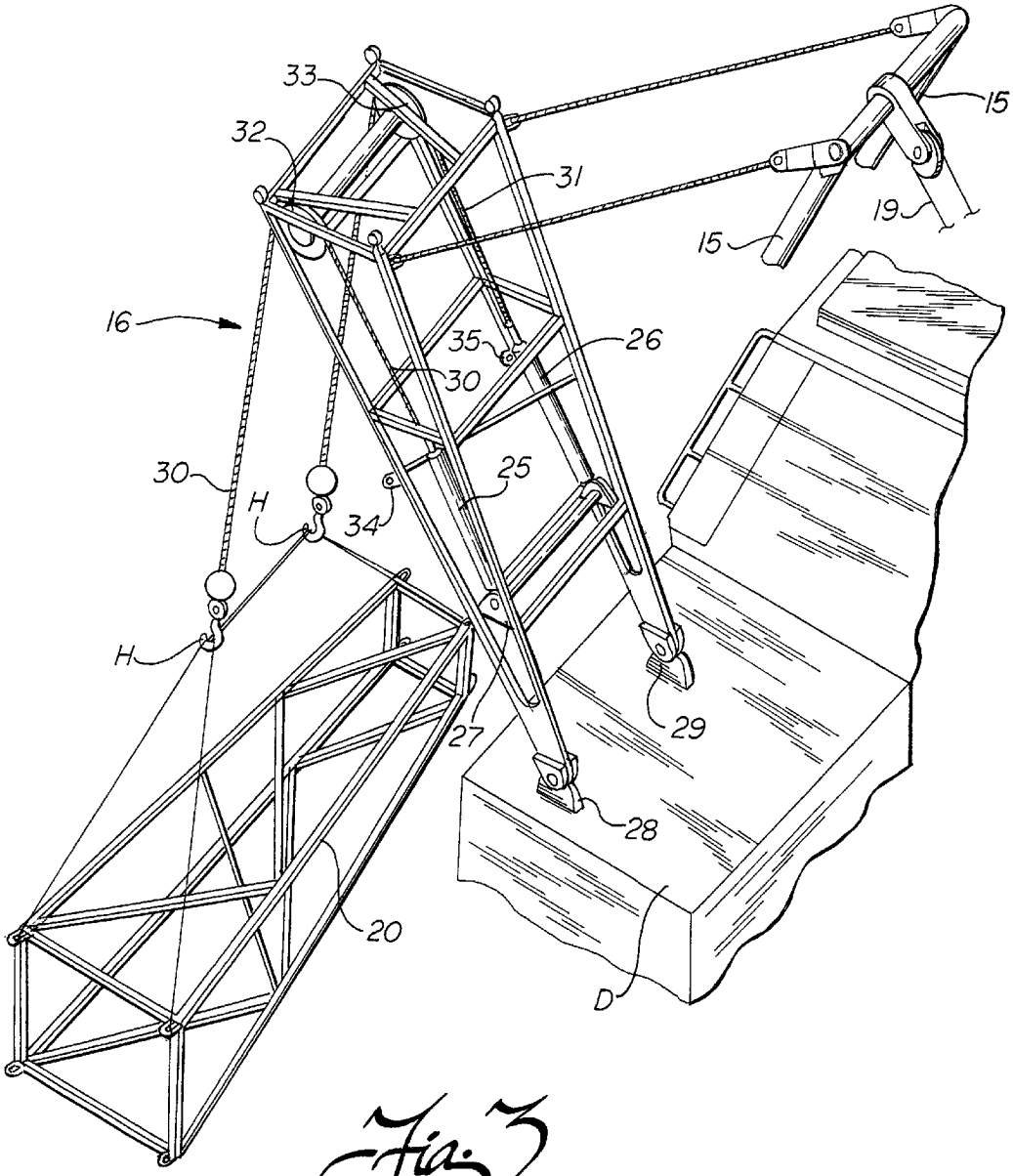
FIG. 3 is a perspective view of the boom base section with lattice parts broken away for clarity, and illustrating the lifting of the boom extension section with the two cylinders, in readiness for turning through 180° and traveling to the position for assembly of the upper boom.

With reference in more detail to FIG. 3, the lifter for performing the raising function of the extension sections 20, 20*a,* as well as all other component parts, is preferably a pair of hydraulic cylinders 25, 26. Advantageously, these relatively narrow cylinders 25, 26 are pivotally mounted on a bracket 27 that spans the width of the lower part of the boom base section 16. The bracket is attached to the four structural legs of the boom base section 16 closely adjacent the proximate end, where main pivot pins 28, 29 attach the section to the deck D of the crane 10. As illustrated, attached to the distal end of the piston rods of the two cylinders 25, 26 are lift lines 30, 31 in the form of wire ropes. These ropes extend over a pair of sheaves 32, 33 also mounted within the confines of the boom base section 16 and directly adjacent the upper end thereof. The lines 30, 31 may each employ a hook H (or other connector) and a pair of slings S for supporting the boom section 20, or other large component parts. Each boom section includes yoke and clevis attachments at the adjacent ends of the side legs for interconnection to form the boom, as is standard. Along the lower side of the bottom legs of the boom base section 16 (one on each side) are attachment eyes 34, 35 to which the hooks H can be attached and the lines 30, 31 can be snugged once the lines are no longer needed for assembly of the crane 10.

Thus, the method of assembling the mobile crane in accordance with the present invention, and in particular assembling the boom by attachment of each of the boom sections 20, 20*a–x* to the boom base section 16, will now be described. The first step is to position the boom sections 20, 20*a–x* stacked on the bed 21 of the truck T, adjacent the crane 10. The slings S are attached to the representative boom extension section 20, and the hooks H of the lines 30, 31 are attached to the slings. The hydraulic cylinders 25, 26 (see FIG. 3) are actuated to substantially fully retract and lift the section 20, as shown in FIG. 1.

Figure 2:
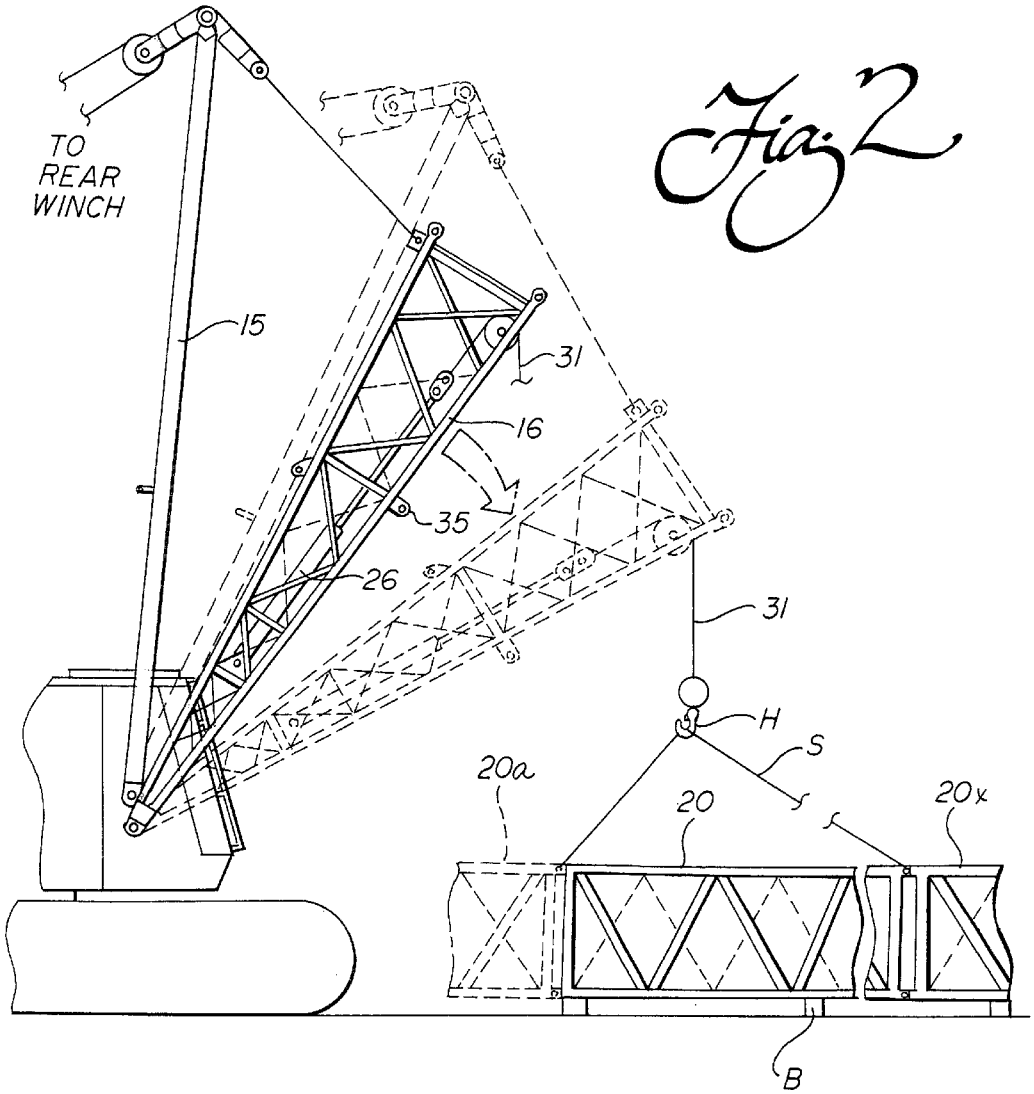
FIG. 2 is a schematic side view, partially broken away for clarity, showing the crane turned 180° in the opposite direction, and moved if necessary on the work site, for assembling the sections of the upper boom.

Once the extension boom section 20 is lifted free, the crane 10 may back away from the trailer T, and after making a turn of the upper works, such as a 180° turn to a position shown in FIG. 2, the extension section 20 can be lowered to adjacent the ground level on to blocks B, as illustrated. In particular, the cylinders 25, 26 are substantially fully extended, as shown, in order to lower the lines 30, 31. Once these lines are extended to their maximum length, if necessary the live mast 15 can be lowered by operation of the rear winch or drum 18 for pay-out of the live mast line 19 (see FIG. 2). This assures placement of the section 20 at ground level, as desired.

Thus, once the boom extension section 20 is in place, the slings S carried by the hooks H can be detached. The boom base section 16 is raised by operation of the live mast 15 (from the dashed line position to the full line position shown in FIG. 2) and the cylinders 25, 26 are fully retracted to their home position. The mobile crane 10, upon swinging through 180° and moving back to the position adjacent the trailer T, is ready to pick up the next extension boom section 20*a* and the process is repeated. As illustrated, the sections 20, 20*a–x* are attached end to end through the yoke and clevis attachment in the normal fashion to form the upper boom.

Figure 2A:
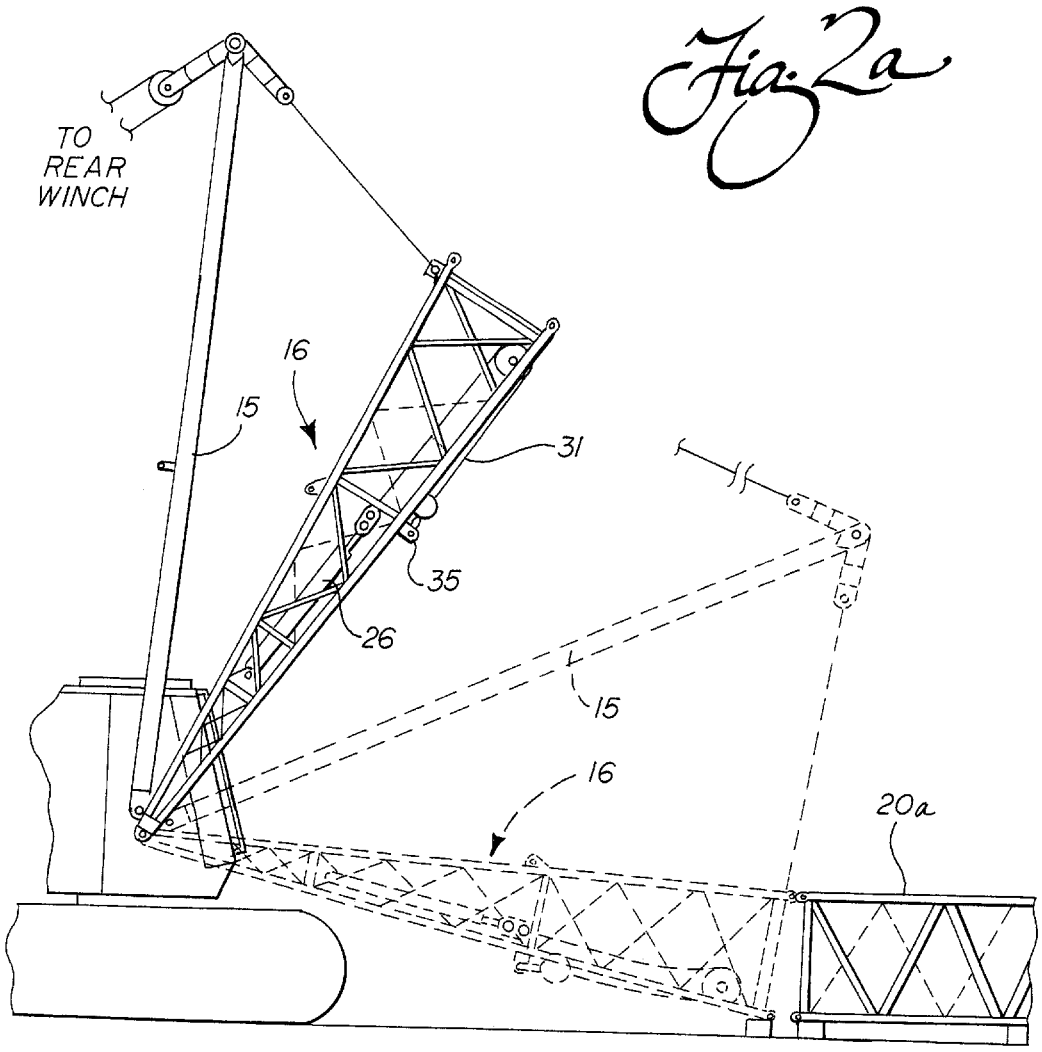
FIG. 2*a* is a partially broken-away side view similar to FIG. 2 showing the step of finally placing the boom base section into position for connecting to the first section of the upper boom to complete the boom assembly process.

From the foregoing, it can be seen that the crane 10 itself can be efficiently used to assemble the boom extension sections together without an attendant crane or other outside help. The self-contained hydraulic cylinders 25, 26, positioned low within the confines of the boom base section 16, provides the lifting height required to handle the extension sections, as well as all other component parts. Each boom section 20, 20*a–x* can be sequentially raised and lowered into close alignment, so as to improve the preassembly of the upper boom over the prior art methods. The use of the hydraulic cylinders 25, 26 provides sure and stable control to also efficiently lower and place these parts in position for pinning together (see FIG. 2*a*). As indicated above, to provide an additional range of movement, the live mast 15 can be lowered (or raised) by operation of the rear winch 18 (see FIG. 2).

Once the boom extension sections 20, 20*a–x* are all unloaded and pinned to each other, and the base section 16 is moved into the lowered position for connection, the final pins are placed in position. The full boom is then lifted by use of the live mast in the manner well known in the industry for its intended load handling tasks.

Figure 5:
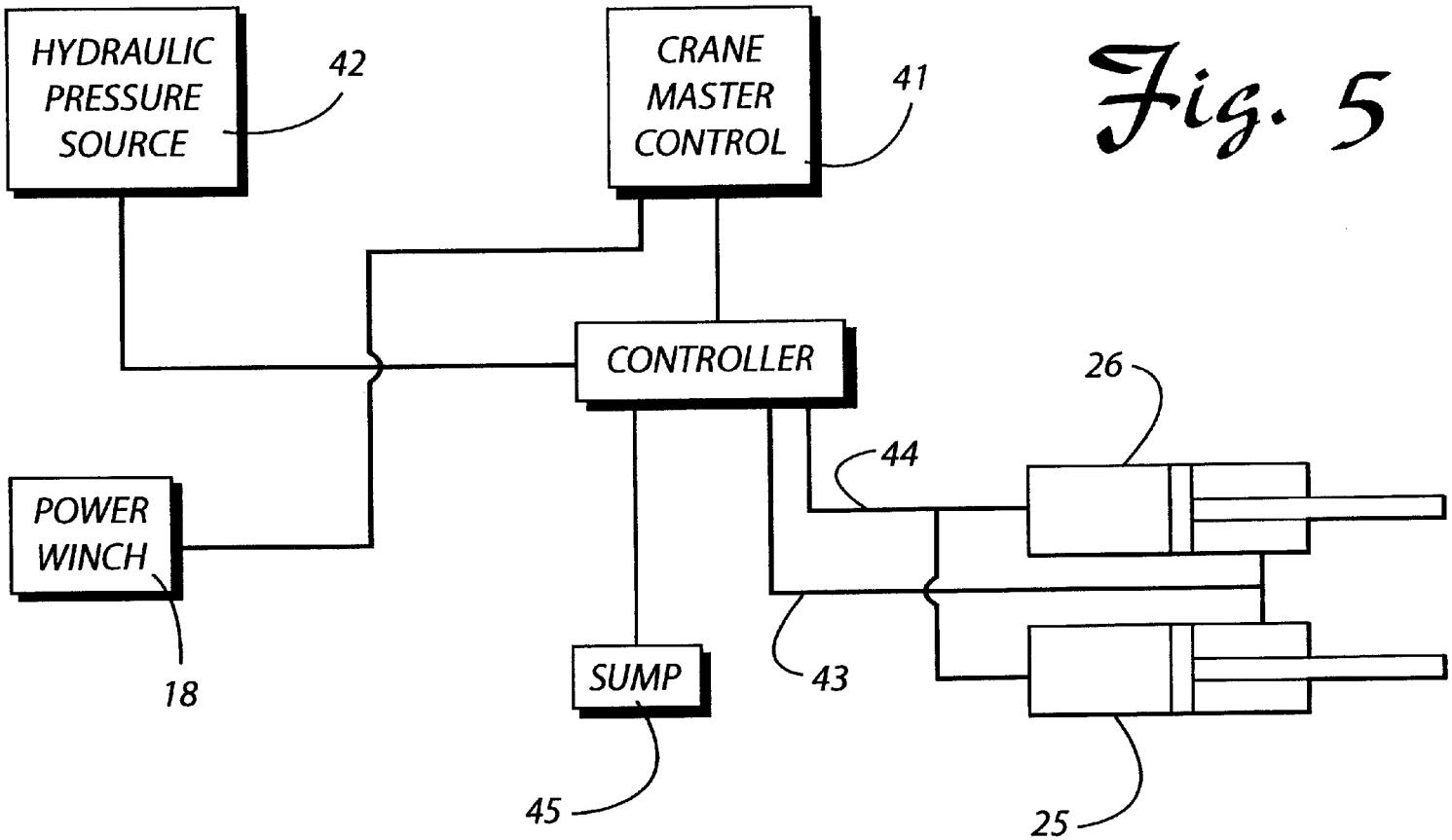
FIG. 5 is a schematic view of the lifter cylinders in a hydraulic control circuit to provide for the desired operation.

The dual cylinders 25, 26 are raised and lowered in unison by a controller 40, as shown in the schematic hydraulic circuit of FIG. 5. The controller 40 is under the control of the master control 41. The rear power winch or drum 18 is also controlled by the operator through the master control 41. A hydraulic pressure source 42 delivers the hydraulic pressure to the cylinders 25, 26 through flow lines 43, 44 and a sump 45 receives the fluid from the side of the piston that is being retracted.

Figure 4:
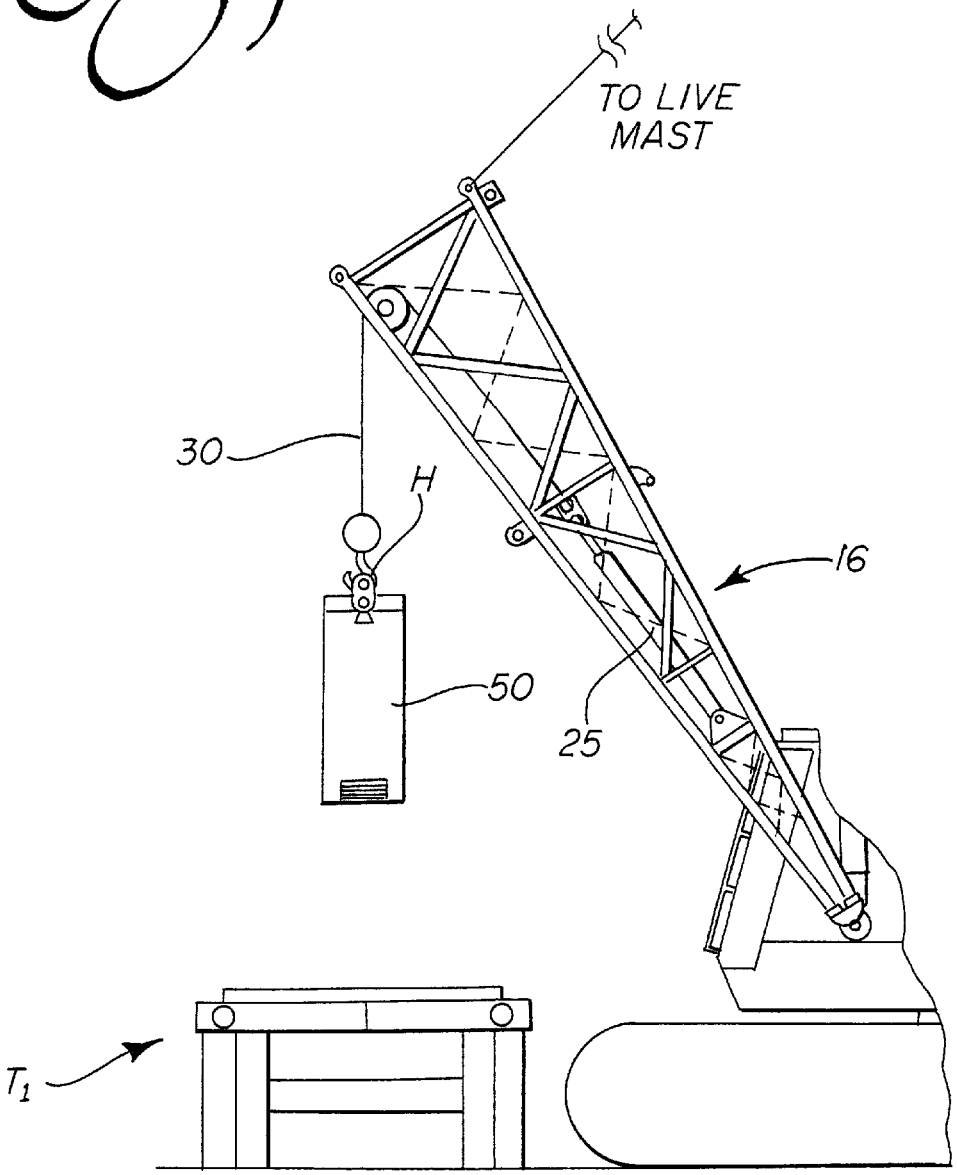
FIG. 4 is a side view, also with parts broken away illustrating the lifting of a counterweight unit from a transport trailer for later positioning for pick-up with the gantry assembly for placement in the counterweight location on the crane.

In addition to handling the boom sections 20, 20*a–x,* as best shown in FIG. 4 the boom base section 16 with the cylinders 25, 26 can be utilized to efficiently lift and place the other component parts in position for assembly to the mobile crane 10. For example, a counterweight 50 is illustrated being picked up from a trailer $T_1$ that is brought into position adjacent the crane 10. Once the counterweight 50 is raised, the crane 10 can be rotated, such as through 180°, and moved if necessary in order to lower it to a pick-up point adjacent the ground (not shown). Once the counterweight 50 is so placed, the hook H can be removed from the integral connector, and it can then be picked up by the gantry assembly 17 and placed in counterweight enclosure 55 in a standard manner.

Once all of the component parts have been properly installed, including the boom base section 16 coupled to the upper assembled boom, the hooks H are placed into the attachment eyes 34 and the cylinders 25, 26 retracted to their maximum amount to tension and snug the lines 30, 31 to a stowage position.

When the crane 10 is ready to be moved to the next work site, the lines 30, 31 are released and the component parts, including the boom extension sections 20, 20*a–x* and the counterweight units 50 can be disassembled and placed back on trailers T, $T_1$ by simply reversing the method steps, as described above.

In summary, it can be seen that a more efficient manner of assembling a medium-heavy duty mobile crane 10 has been provided. No attendant crane is required to assist in the process. The load handling boom is efficiently self-assembled by utilizing the boom base section 16 to handle the extension sections 20, 20*a–x,* as described. Advantageously, the cylinders 25, 26 fit totally within the confines of the boom base section 16, well within the reduced space provided. The bases of the cylinders attach to the bracket 27 adjacent the proximate end (close to the pivot mounting of the boom). These cylinders are thus self-contained and dedicated to the assembly and disassembly process. The lines 30, 31 provide the lift height required to pick up, lower and place the extension sections in just the right position for assembly. If necessary, the live mast 15, or other equivalent support for the base section 16, can be used for an additional range of movement. Furthermore, the counterweight units 15, along with other component parts as required, can also be efficiently lifted and lowered through the same operation of the hydraulic cylinders 25, 26. In this manner, there is no need for time consuming rerigging of any component parts, including the main load lifting lines, or other tedious steps that need to be performed, as in the past.

The foregoing description of the preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A method of self-assembling a mobile crane having a load handling boom including a base section and at least two extension sections, comprising the steps of:

positioning the extension sections adjacent the crane;

sequentially raising each extension section with a lifter including at least one hydraulic cylinder mounted inside the base section by fastening a line attached to the cylinder to the extension section;

using the cylinder to lower each extension section to a position for connection to the base section to form the boom, whereby the crane can be efficiently assembled without an assist crane.

2. The method according to claim 1, wherein the lifter includes dual hydraulic cylinders and the raising is performed by actuating the cylinders in unison.

3. The method according to claim 1, wherein the lifter is self-contained and further including the step of moving both the lifter and the boom base together as a unit once the crane is assembled.

4. A method of self-assembling a mobile crane having a load handling boom including a base section and a plurality of boom extension sections to provide the complete working crane, comprising the steps of:

positioning the boom extension sections adjacent the crane;

using a dedicated lifter including a hydraulic cylinder carried on the base section of the load handling boom to sequentially raise and lower the boom extension sections;

placing the boom extension sections when lowered into alignment to preassemble an upper boom;

connecting the upper boom to the base section to complete the crane, whereby the crane can be efficiently assembled without an assist crane.

5. The crane self-assembly method of claim 4, further including the step of transporting the crane to a work site on a separate vehicle with the boom base section connected thereto is performed prior to the positioning of the at least one component part.

6. The crane self-assembly method of claim 4, wherein the lifter includes dual hydraulic cylinders and the raising and lowering steps are performed by actuating the cylinders in unison by a controller.

7. The crane self-assembly method of claim 4, wherein the lifter is self-contained and further including the step of moving both the lifter and the base section together as a unit once the crane is assembled.

8. A method of self-assembling a mobile crane including a main winch associated with a first hoist line for raising and lowering a load handling boom having a boom base section, comprising the steps of:

positioning a boom extension section adjacent to, but not connected to the crane;

connecting the boom extension section to at least one second hoist line supported by a sheave, the second hoist line being separate from the first hoist line associated with the main winch for raising and lowering the boom; and using a lifter carried on the boom base section to raise or lower the second hoist line as necessary to place the boom extension section in a position for connection to the boom base section;

whereby the crane can be efficiently assembled without an assist crane.

9. The method of claim 8, wherein the lifter comprises at least one hydraulic cylinder, and the method includes using the hydraulic cylinder to raise and lower the boom extension section.

* * * * *